United States Patent [19]

Wong

[11] Patent Number: 4,991,633

[45] Date of Patent: Feb. 12, 1991

[54] SANITARY PACKAGING SYSTEM

[75] Inventor: David M. Wong, Chesterfield, Mo.

[73] Assignee: Mallinckrodt, Inc., St. Louis, Mo.

[21] Appl. No.: 473,072

[22] Filed: Jan. 31, 1990

[51] Int. Cl.[5] ..... B65B 1/16

[52] U.S. Cl. ..... 141/5; 141/10; 141/63; 141/83; 141/85; 141/97; 141/114; 141/130; 141/314; 312/1; 53/512; 53/434

[58] Field of Search ..... 141/1, 4, 5, 10, 37, 141/63, 83, 85, 93, 94, 97, 98, 99, 114, 130, 313, 314, 317; 312/1; 53/432, 434, 167, 510, 512

[56] References Cited

U.S. PATENT DOCUMENTS

| | | | |
|---|---|---|---|
| 2,853,105 | 9/1958 | Brown | 141/10 X |
| 3,393,491 | 7/1968 | Burton et al. | 141/85 |
| 3,667,512 | 6/1972 | Jackson | 141/130 |
| 4,344,468 | 8/1982 | Sandberg | 141/114 X |
| 4,373,547 | 2/1983 | Geis et al. | 141/98 X |
| 4,478,332 | 10/1984 | Wiestmiller | 141/83 X |
| 4,538,659 | 9/1985 | Adelman et al. | 141/97 X |
| 4,569,377 | 2/1986 | Ellis | 141/98 |
| 4,688,371 | 8/1987 | Hecht | 141/83 X |

FOREIGN PATENT DOCUMENTS

| | | | |
|---|---|---|---|
| 0699885 | 11/1940 | Fed. Rep. of Germany | 141/314 |
| 0111601 | 4/1989 | Japan | 141/317 |
| 21853 | 4/1909 | United Kingdom | 141/85 |
| 2097770 | 11/1982 | United Kingdom | 141/85 |

OTHER PUBLICATIONS

Fran Rica aseptic flexible bag fillers advertisement (no date).

*Primary Examiner*—Ernest G. Cusick

*Attorney, Agent, or Firm*—Rita E. Downard; Roy J. Klostermann

[57] ABSTRACT

A sanitary packaging system and method of using the same for the packaging of a sanitary product comprising a sanitary housing portion, a product bag, a sliding adjustment tube and a product tube. The product tube extends inside the sanitary housing portion and is flexibly attached to the sliding adjustment tube to which the product bag is attached. The sanitary product under pressure passes through the product tube, sliding adjustment tube and into the product bag to complete packaging. Sanitized air is blown through the sanitary housing enclosure to create a positive pressure therein, whereby in the case of a leak within the product bag, sliding adjustment tube or product entry tube, sanitary product leaks outwardly therefrom rather than allowing contaminates to be pulled inwardly and contaminate said sanitized product.

18 Claims, 2 Drawing Sheets

SANITARY PACKAGING SYSTEM

BACKGROUND OF THE INVENTION

This invention relates to a sanitary packaging system, and in particular, to a sanitary packaging system which prevents bacterial, microbial and particulate contamination of a final packaged product while providing a means of sanitary sampling of the product during the sanitary packaging process.

Throughout the packaging process of many various types of products, sanitary conditions must be continuously maintained to ensure product purity and to prevent bacterial, microbial, and particulate contamination. Although manufacturers and designers have in the past claimed to have provided sanitary packaging systems, none have been successful in maintaining a bacterial and microbial free product environment rather than simply a particulate free environment. There is therefore a need for a sanitary packaging system which is specifically designed to eliminate bacterial, microbial and particulate contamination during the packaging process of a product.

In general, it is an object of the present invention to provide a sanitary packaging system which will enable the sterile packaging of a product.

Another object of the present invention is to provide a sanitary packaging system which maintains a bacterial, microbial and particulate free environment while being easy and convenient to use.

Another object of the present invention is to provide a sanitary packaging system of the above character which in comparison to currently existing packaging systems in easily and inexpensively constructed.

Another object of the present invention is to provide a sanitary packaging system of the above character which allows for sampling of the product during the packaging process without bacterial, microbial and particulate contamination.

Additional objects and features of the present invention will appear from the following description in which the preferred embodiment is set forth in detail in conjunction with the accompanying drawings.

DETAILED DESCRIPTION OF THE INVENTION

Figure 1:
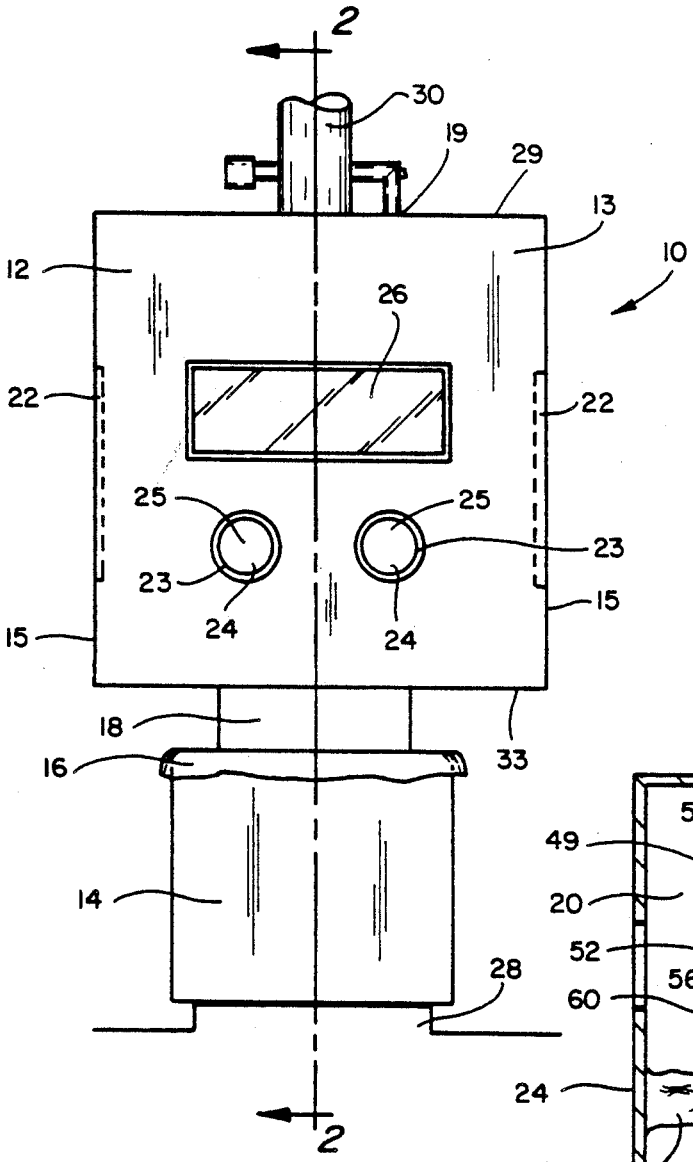
FIG. 1 is a front view of the sanitary packaging system of the present invention.

In the drawings, the preferred embodiment of the present sanitary packaging system, made in accordance with the teachings of this invention, is indicated generally by the numeral 10. The present sanitary packaging system 10 is best illustrated in FIGS. 1 and 2 and comprises sanitary housing 12, rigid container 14, liner member 16, product bag 18 and scale 28.

Sanitary housing 12 is essentially of a square or a rectangular cube construction having a hollow interior portion 20. However, although the preferred embodiment as illustrated is of this particular geometric shape, any desired shape could be used. A front surface 13 of sanitary housing 12 is equipped with a window 26 and two glove ports 24 positioned below window 26. Glove ports 24 are made up of openings 23 having gloves 25 attached therein, thereby enabling one to enter into the interior portion 20 of sanitary housing 12 by inserting one's hands into the gloves 25. This allows for manipulation of the packaging mechanism within sanitary packaging system 10 without contamination thereof. Sanitary housing 12 is also constructed to have two side doors 22 each being positioned in a side surface 15 of sanitary housing 12 so as to be opposing each other and adjacent to the front surface 13. Sanitary housing 12 is additionally designed to have an opening 17 in a top surface 29 thereof.

Entering sanitary housing 12 through opening 17 and forming an air-tight seal with top surface 29 is product tube 30. Product tube 30 is preferably tubular in shape having no harsh curves or bends whereby product could get clogged or collect. However, any design which prevents product clogging or collection could be used. Product tube 30 is also designed to have a base portion 35 which has rubberized attachment means 56 to hold an edge 53 of a resilient plastic shielding 58 in air-tight communication with the product tube 30. Likewise, an opposed free edge 55 of plastic shielding 58 is attached to a sliding tube 50 by means of rubberized attachment means 54 whereby height adjustments may be made with the sliding tube 50 to provide proper support for product bag 18. These adjustments may be made by raising or lowering sliding tube 50 to the appropriate height for product bag 18. Coating a side portion 49 of sliding tube 50 is a rubber coating band 60. Product bag 18, constructed of a heavy gauge plastic material preferably having a gauge of approximately 20 mils, is gathered around rubber coating band 60 and fastened thereto by means of an adjustable 360° clamp 52 so as to be air tight. The resilient rubber coating band 60 in conjunction with the 360° clamp 52 makes it possible to achieve an air-tight seal, even when under pressure, with the gathered plastic material of product bag 18 due to the resiliency of rubber coating band 60. Product bag 18 while so fixed to sliding tube 50 is positioned to extend downwardly and outwardly from an opening 31 in a bottom surface 33 of sanitary housing 12. A lower so extended portion 37 of product bag 18 is positioned inside a liner 16 supported by a rigid container 14. Rigid container 14 is preferably positioned on a scale 28 to enable measurement of the weight of product packaged.

Figure 2:
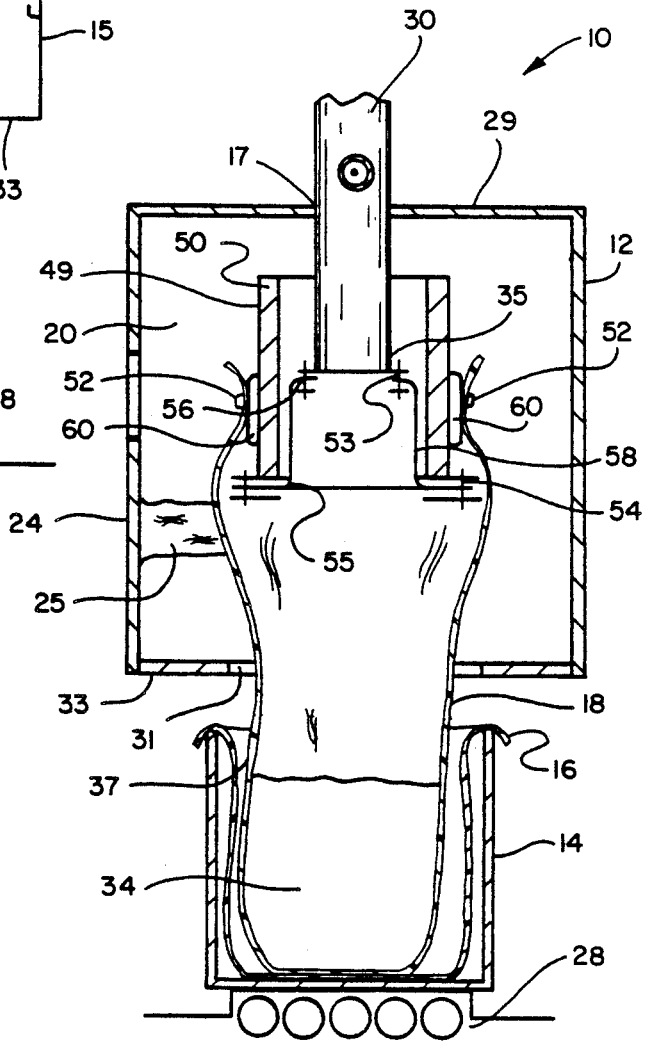
FIG. 2 is a cross sectional view of the sanitary packaging system of FIG. 1 taken along line 2—2.
Figure 3:
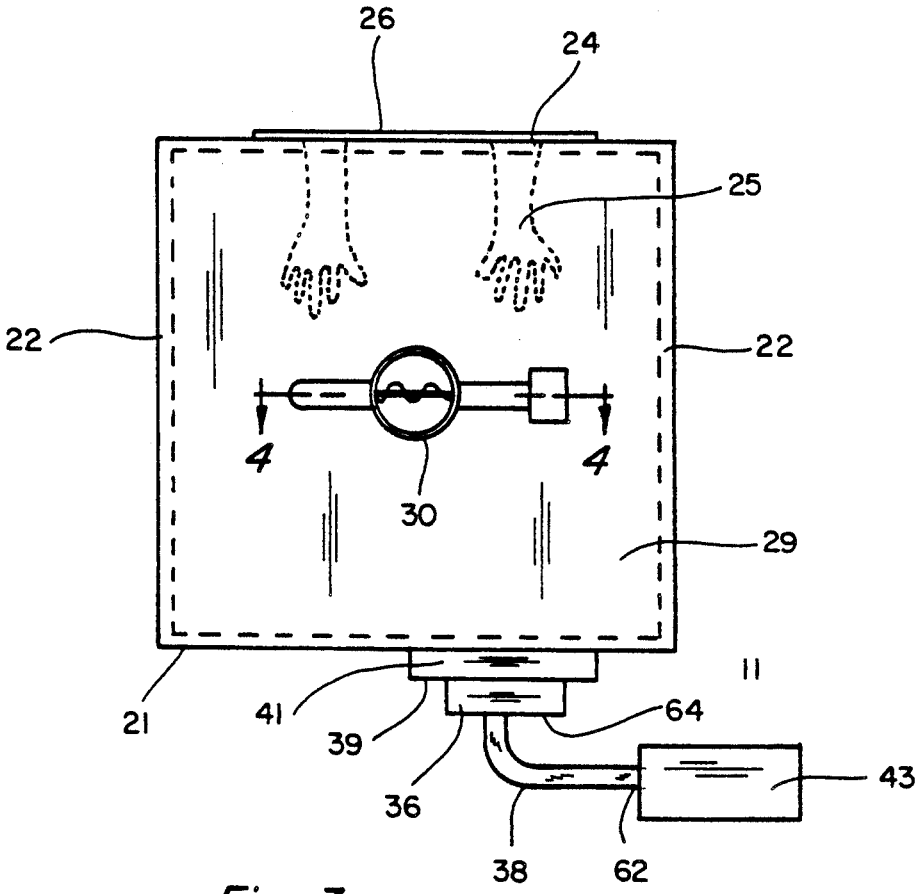
FIG. 3 is a top view of the sanitary packaging system of FIG. 1.
Figure 4:
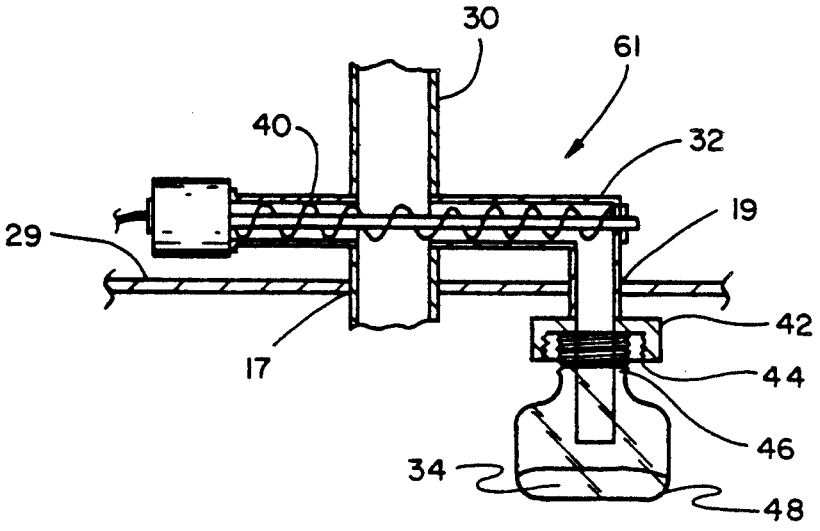
FIG. 4 is a cross sectional view of the sampling system portion of the sanitary packaging system of FIG. 3 taken along line 4—4.

A sampling system portion 61 of sanitary packaging system 10 is best illustrated in FIGS. 1, 3 and 4. The sampling system 61 is connected to product tube 30 and enters into sanitary housing 12 through an opening 19 in top surface 29 by means of a jointed or curved sample tube 32. An air-tight seal is formed between sample tube 32 and top surface 29. Inside sanitary housing 12, sample tube 32 connects to bottle holder 42. Bottle holder 42 snaps over and interlocks with lid member 44 which engages by means of threadedly engageable means 46 to sample bottle 48. The sampling system works by means of an auger 40 located inside sample tube 32 and product tube 30. When product 34 is passing through product tube 30, the auger 40 catches a part of product 34 and pushes it along sampling tube 32 to fall into and fill sample bottle 48. When sample bottle 48 is full, it is manually removed from lid member 44 through the use of the gloves 25 in glove ports 24, and a new sanitary lid stored inside sanitary housing 12 is used to seal sample bottle 48 before removing it from sanitary housing 12 by means of opening 31 in bottom surface 33. A new sanitary sample bottle 48 also stored in sanitary housing 12 is then threadedly engaged to lid member 44 to repeat the process.

Another feature of sanitary housing 12 best illustrated in FIG. 3 is back panel 21 of sanitary housing 12 which has an opening 11 exteriorly covered by a filter 41. Filter 41 is preferably a high efficiency particular air (HEPA) filter. Attached to an exterior surface 39 of filter 41 is pre-filter 36. Both filter 41 and pre-filter 36 are specially designed air filters proven to remove bacterial, microbial and particulate contamination from the air. Attached to the exterior surface 64 of pre-filter 36 is blower tube 38 to which a blower is attached. The blower 43 supplies a flow of air, which has been sanitized by filters 36 and 41, through the sanitary housing 12 to create a positive pressure therein as is discussed in more detail below.

The present sanitary packaging system 10 is operated by first employing a blower 43 connected to the free end 62 of blowing tube 38 to force air through pre-filter 36 and filter 41 to remove bacterial, microbial and particulate contaminates from the air. The sanitized air enters sanitized housing 12 through opening 11 and exits through opening 31 thereby creating a positive pressure (or suction force) within sanitary housing 12 of approximately 0.02 psig above atmospheric pressure. Due to the positive pressure (suction) thereby created, any leaks that may develop in product tube 30, plastic shielding 58, sliding tube 50 or product bag 18 causes product 34 to travel outwardly from the leak rather than allowing air and possibly contaminates to be pulled therein. Additionally, the product 34 while passing through product tube 30, plastic shielding 58, sliding tube 50 and into product bag 18 is likewise under pressure, preferably ranging between 0.2–0.3 psig above atmospheric pressure, to ensure that the product 34 will be forced outwardly through any areas of leakage rather than allowing contaminates to enter therein. This causes a small loss of product should any leaks occur as the product 34 is passing through product tube 30, plastic shielding 58, sliding tube 50 and into product bag 18, but is preferable to ensure the purity of product 34. As product 34 enters into product bag 18 it is weighed on scale 28 until the desired amount has been packaged. Then by means of the gloves 25 in glove ports 24, product bag 18 is manually removed from clamp 52 and sealed by using an adhesive, folding, tying, heat sealing or any other acceptable means or combination of means. Packaged product bag 18 is then removed from sanitary housing 12 through opening 31 in bottom surface 33. A new sanitary product bag 18 is then repositioned over rubber coating band 60, and then gathered and fastened thereto by clamp 52 to repeat the sanitary packaging process.

In constructing the present sanitary packaging system 10, the window 26 and sample bottle 48 may constructed of any suitable transparent material, natural or synthetic. The plastic shielding 58, product bag 18, liner member 16, rubber coating band 60 and gloves 25 may be constructed from a resilient synthetic monomer, a resilient synthetic polymer or natural rubber. All rigid attachment means are coated with a natural or synthetic rubber material to prevent slippage and to form air-tight seals. All remaining components of the sanitary packaging system 10 may be constructed from any suitable rigid material such as metal, metal alloys, wood, rigid synthetic polymers, rigid synthetic monomers or a combination thereof.

The foregoing has been a description of the preferred embodiment of the present invention. Although many specific details have been described, it should be understood that the description is only for the purpose of explaining the invention, and not limiting it. The scope of the invention may be ascertained from the following appended claims.

What is claimed is:

1. A sanitary packaging system comprising:

a. a sanitary housing portion, b. a product tube adapted to have a free edge extend inside said sanitary housing portion to allow the passage of a sanitary product into said sanitary housing portion, c. first attachment means located on said free edge of said product tube within said sanitary housing portion, d. a sliding adjustment tube having a diameter slightly larger than that of said product tube and affixed first attachment means, e. second attachment means located on an interior surface of said sliding adjustment tube, f. a resilient shielding member attached by one free end to said first attachment means and by an opposed free end to said second attachment means to allow slideable adjustment of said slideable adjustment tube with respect to said product tube, g. an adjustable clamp attachment means located on an exterior surface of said sliding adjustment tube, h. a product bag removeably attached by means of said adjustable clamp attachment means to said slideable adjustment tube as to be in direct communication with said product tube, for receiving said sanitary product, i. an opening for access to an inside portion of said sanitary housing portion for removal of said product bag, and j. air inlet and outlet openings, whereby a blower is attached to blow sanitized air through said sanitary housing portion to create a positive pressure current therein ensuring that in the case of a leak in said sanitary packaging system, sanitary product will leak outwardly from said product tube, sliding adjustment tube, resilient shielding member and product bag, and their means of attachment rather than contaminates being pulled therein.

2. A sanitary packaging system as described in claim 1 wherein a sanitary sampling system is in fluid communication with said product tube and is partially enclosed within said sanitary housing portion for sanitary sampling of said sanitary product.

3. A sanitary packaging system as described in claim 1 wherein said product bag extends outwardly from said sanitary housing portion through said air outlet opening.

4. A sanitary packaging system as described in claim 1 wherein said product bag extends outwardly from said sanitary housing portion and is adapted to rest on a scale for measurement of the weight of said sanitary product packaged inside said product bag.

5. A sanitary packaging system as described in claim 1 wherein said product bag extends outwardly from said sanitary housing portion through said air outlet opening and is adapted to rest inside a liner bag adapted to be supported by a rigid container.

6. A sanitary packaging system as described in claim 1 wherein said product bag extends outwardly from said sanitary housing portion through said air outlet opening and is adapted to rest inside a liner bag adapted to be supported by a rigid container which is adapted to be positioned on a scale to measure the weight of said sanitary product packaged inside said product bag.

7. A sanitary packaging system as described in claim 1 wherein a window is located in said sanitary housing portion for visual inspection within said sanitary housing portion.

8. A sanitary packaging system as described in claim 1 wherein gloves adapted to attach inside glove port openings are positioned in said sanitary housing portion for manual manipulation of said sanitary product and product bag while maintaining said sanitary product and product bag in a sanitary state.

9. A sanitary packaging system as described in claim 1 wherein a filter, a pre-filter and a tube are adapted to attach to said air inlet opening to remove bacterial, microbial and particulate contaminates from air blown from an attached blower, while allowing free passage of resulting sanitized air through said sanitized housing portion.

10. A method of sanitary packaging of a product comprising:

a. attaching a product bag to a sliding adjustment tube within a sanitary housing enclosure, b. adjusting said sliding adjustment tube with respect to an attached product entry tube for positioning of said product bag, c. employing a blower to blow sanitized air through said sanitary housing enclosure by means of an air inlet and an air outlet opening, and d. allowing a sanitary product to flow through said product entry tube under pressure into said sanitary housing enclosure, through said sliding adjustment tube and into said product bag to package said product whereby said sanitized air blown into said air inlet, through said sanitary housing enclosure and out said air outlet, creates a positive pressure current therein to ensure upon development of any leakage within said product bag, said sliding adjustment tube, and said product entry tube causes sanitary product to be pulled outwardly therefrom by said positive pressure rather than allowing contaminates to be pulled inwardly and contaminate said sanitized product.

11. A method of sanitary packaging of a product as described in claim 10 wherein a sanitary sampling system is in fluid communication with said product entry tube and is partially enclosed within said sanitary housing enclosure for sanitary sampling of said sanitary product.

12. A method of sanitary packaging of a product as described in claim 10 wherein said product bag extends outwardly from said sanitary housing enclosure through said air outlet opening.

13. A method of sanitary packaging of a product as described in claim 10 wherein said product bag extends outwardly from said sanitary housing enclosure and is adapted to rest on a scale for measurement of the weight of said sanitized product packaged inside said product bag.

14. A method of sanitary packaging of a product as described in claim 10 wherein said product bag extends outwardly from said sanitary housing enclosure through said air outlet opening and is adapted to rest inside a liner bag adapted to be supported by a rigid container.

15. A method of sanitary packaging of a product as described in claim 10 wherein said product bag extends outwardly from said sanitary housing enclosure through said air outlet opening adapted to rest inside a liner bag supported by a rigid container adapted to be positioned on a scale to measure the weight of said sanitary product packaged inside said product bag.

16. A method of sanitary packaging of a product as described in claim 10 wherein a window is located in of said sanitary housing enclosure for visual inspection within said sanitary housing enclosure.

17. A method of sanitary packaging of a product as described in claim 10 wherein gloves adapted to attach inside glove port openings are positioned in said sanitary housing enclosure for manual manipulation of said sanitary product, and product bag while maintaining the same in a sanitary state.

18. A method of sanitary packaging of a product as described in claim 10 wherein a filter, a pre-filter and a tube are attached to said air inlet opening to remove bacterial, microbial and particulate contaminates from air blown from an attached blower, while allowing free passage of resulting sanitized air through said sanitary housing enclosure.

* * * * *